US011817650B2

(12) United States Patent
Corneteau et al.

(10) Patent No.: US 11,817,650 B2
(45) Date of Patent: Nov. 14, 2023

(54) CONNECTION BETWEEN A REINFORCED HARNESS AND AN ELECTRICAL COMPONENT

(71) Applicant: SAFRAN HELICOPTER ENGINES, Bordes (FR)

(72) Inventors: Samuel Joël Raphaël Corneteau, Moissy-Cramayel (FR); Jean-Marc Gérard Mounolou, Moissy-Cramayel (FR); Cyril Jean-Noël Gabriel Vasquez, Moissy-Cramayel (FR)

(73) Assignee: SAFRAN HELICOPTER ENGINES, Bordes (FR)

( * ) Notice: Subject to any disclaimer, the term of this patent is extended or adjusted under 35 U.S.C. 154(b) by 142 days.

(21) Appl. No.: 17/600,638

(22) PCT Filed: Mar. 25, 2020

(86) PCT No.: PCT/EP2020/058401

§ 371 (c)(1),
(2) Date: Oct. 1, 2021

(87) PCT Pub. No.: WO2020/200970

PCT Pub. Date: Oct. 8, 2020

(65) Prior Publication Data

US 2022/0200197 A1 Jun. 23, 2022

(30) Foreign Application Priority Data

Apr. 5, 2019 (FR) ..... 1903680

(51) Int. Cl.
*H01R 13/58* (2006.01)
*H01R 13/516* (2006.01)
(Continued)

(52) U.S. Cl.
CPC ..... *H01R 13/5804* (2013.01); *H01R 13/516* (2013.01); *H01R 13/6592* (2013.01); *H01R 13/6608* (2013.01)

(58) Field of Classification Search
CPC ..... H01R 13/5804; H01R 13/516; H01R 13/6592; H01R 13/6608
See application file for complete search history.

(56) References Cited

U.S. PATENT DOCUMENTS 3,280,246 A 10/1966 Lawson et al.
4,666,229 A * 5/1987 Grand ..... H02G 3/0666 439/451

(Continued)

FOREIGN PATENT DOCUMENTS

FR 2694990 A1 2/1994
WO 2011076819 A2 6/2011

OTHER PUBLICATIONS

Search Report issued in French Patent Application No. 1903680 dated Nov. 28, 2019.

(Continued)

*Primary Examiner* — Travis S Chambers
(74) *Attorney, Agent, or Firm* — Pearne & Gordon LLP

(57) ABSTRACT

A connection includes a widened reinforcement harness which comprises a reinforced harness, a non-deformable ferrule and a reinforcement portion which has a greater diameter than the reinforcement of the harness, the non-deformable ferrule being arranged around the harness with (Continued)

the reinforcement of the harness folded on the outer side of the non-deformable ferrule, a first end of the reinforcement portion being attached around the folded portion of the reinforcement of the harness, the connection further comprising an integrated coupling connector, a second end of the reinforcement portion of the widened reinforcement harness being attached to a section of the integrated coupling connector. This connection is particularly advantageous for the small harness, wherein the reinforcement of the harness has a diameter which is too small to surround the section of an integrated coupling connector.

10 Claims, 2 Drawing Sheets

(51) Int. Cl.
*H01R 13/6592* (2011.01)
*H01R 13/66* (2006.01)

(56) References Cited

U.S. PATENT DOCUMENTS 5,399,808 A 3/1995 Carter et al.
6,419,519 B1 * 7/2002 Young ..... H01R 13/5812 439/446
7,029,315 B2 * 4/2006 Dang ..... H01R 13/5841 439/468
7,837,495 B2 * 11/2010 Baldwin ..... H01R 13/622 439/459
8,347,495 B2 * 1/2013 Biesse ..... H01R 13/502 29/874
9,948,027 B2 * 4/2018 Sandwith ..... H01R 13/58

OTHER PUBLICATIONS

International Search Report issued in Application No. PCT/EP2020/058401 dated May 25, 2020.
Written Opinion issued in Application No. PCT/EP2020/058401 dated May 25, 2020.

* cited by examiner

CONNECTION BETWEEN A REINFORCED HARNESS AND AN ELECTRICAL COMPONENT

This is the National Stage of PCT international application PCT/EP2020/058401, filed on Mar. 25, 2020 entitled "CONNECTION BETWEEN A REINFORCED HARNESS AND AN ELECTRICAL COMPONENT", which claims the priority of French Patent Application No. 1903680 filed Apr. 5, 2019, both of which are incorporated herein by reference in their entirety.

TECHNICAL FIELD

The present invention relates to the field of connection between a reinforced harness and an electrical component, in particular an integrated coupling connector, as well as a method for coupling a reinforced harness to an electrical component, in particular an integrated coupling connector.

PRIOR ART

In aircraft, the electrical couplings are made primarily by means of electrical harnesses. These electrical harnesses typically comprise a reinforcement surrounding the strand of cables for electromagnetic (EM) protection, in particular to attenuate EM disturbances received or transmitted by the harness.

To couple a reinforced harness to a connector, a rear coupling (or "backshells") is often used. The rear coupling allows the electrical coupling of the harness to the connector while maintaining the EM protection around the connection. More specifically, the rear coupling is a metal part, tubular in shape generally flared towards the front. The harness cables intended to be plugged into the connector pass inside the rear coupling via a passage at the rear, while the reinforcement of the harness is attached around a coupling section surrounding the passage. Once the cables are plugged in, the rear coupling is coupled forward to the connector. Various shapes of rear coupling exist allowing reinforced harnesses of different diameters to be coupled reliably to connectors, even those of small diameter.

However, an integrated coupling connector is sometimes preferred because it is lighter. Moreover, it is also less complicated to install because it comprises one less component, effectively integrating the functions of the connector and the rear coupling in one piece. Unfortunately, a small diameter harness cannot be properly coupled to such a connector. In particular, the passage at the rear of the integrated coupling connector should be wide enough to allow the insertion as well as the plugging of the cables to the connector portion of the integrated coupling connector, and therefore the section of the integrated coupling connector cannot be reduced beyond a certain diameter. Consequently, it is difficult to attach the reinforcement of a small diameter harness around this section.

Thus, the reinforcement of the small diameter harness is often attached so that it only partially surrounds the section of the integrated coupling connector, or not attached at all. Sometimes the reinforcement is forced to surround the section, which distorts the harness reinforcement mesh and leaves windows through which EM disturbances can be received or transmitted. In any case, the EM protection represents a significant regression and is not satisfactory.

There is therefore a need to make a connection between an integrated coupling connector and a reinforced harness capable of maintaining good EM protection.

Presentation of the Invention

The object of the present invention is consequently to overcome the aforementioned needs and disadvantages by proposing a widened reinforcement harness comprising a reinforced harness, a non-deformable ferrule and a reinforcement portion which is distinct and has a greater diameter than the reinforcement of the harness, the non-deformable ferrule being arranged around the harness with the reinforcement of the harness passing inside the non-deformable ferrule and folded on the outer side of the non-deformable ferrule, a first end of the reinforcement portion being attached around the folded portion of the reinforcement of the harness and a second end being arranged to be attached to a section of an electrical component.

Preferably, the first end of the reinforcement portion is attached with a clamp.

Advantageously, a first heat-shrinkable sleeve envelops the first end of the reinforcement portion.

The object of the present invention also provides a connection, comprising an electrical component with a section and a widened reinforcement harness as described above, the second end of the reinforcement portion being attached around the section of the electrical component.

Preferably, the second end of the reinforcement portion is attached with a clamp.

More preferably, the electrical component is an integrated coupling connector.

Advantageously, a second heat-shrinkable sleeve envelops the first end of the reinforcement portion as well as a portion of the first heat-shrinkable sleeve, and further envelops the second end of the reinforcement portion.

The object of the present invention also provides a method for coupling the reinforcement of a reinforced harness to a section of an electrical component, the method comprising providing a non-deformable ferrule around the reinforced harness, folding the reinforcement of the harness from the inner side of the non-deformable ferrule to the outer side of the non-deformable ferrule, providing a reinforcement portion which is distinct and has a greater diameter than the reinforcement of the harness, attaching one end of the reinforcement portion around the folded portion of the reinforcement of the harness, and attaching the second end of the reinforcement portion to the section of the electrical component.

Preferably, the method comprises attaching each of the ends of the reinforcement portion with a clamp.

Advantageously, the method comprises attaching the reinforcement of the harness to the section of an integrated coupling connector.

BRIEF DESCRIPTION OF THE FIGURES

Other features and advantages of the invention will become apparent upon reading a preferred embodiment of the invention, described with reference to the appended figures, among which.

DESCRIPTION OF EMBODIMENTS

Figure 1:
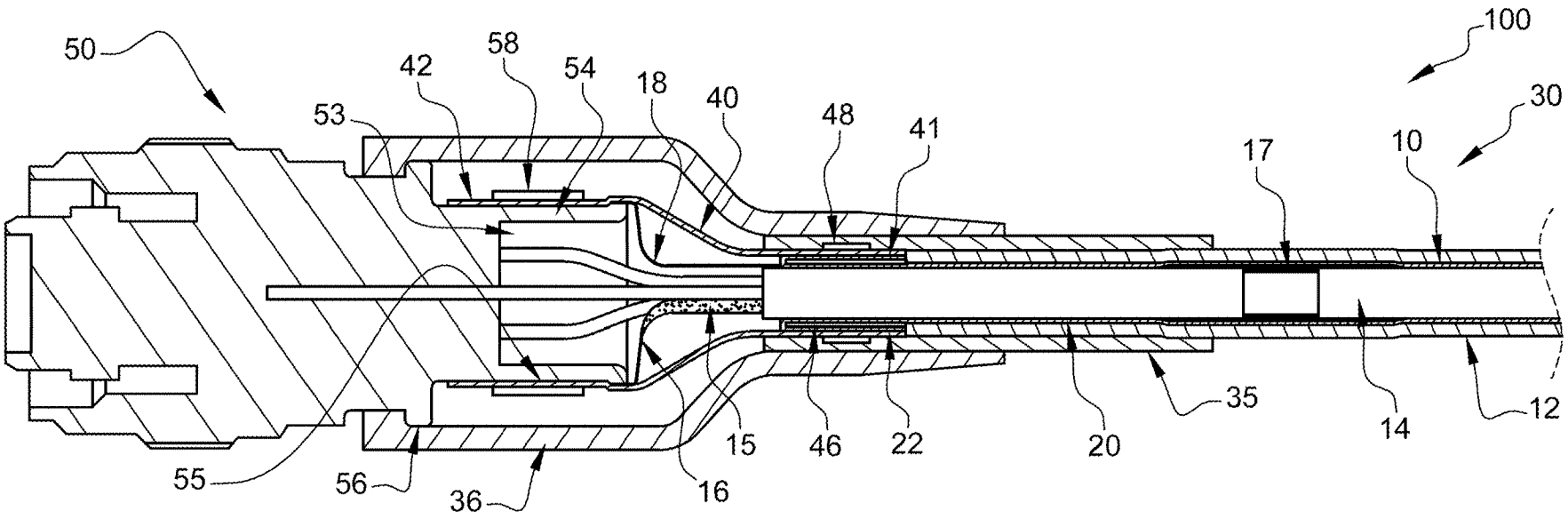
FIG. 1 shows a cross-sectional view of a connection between an integrated coupling connector and a harness.
Figure 2:
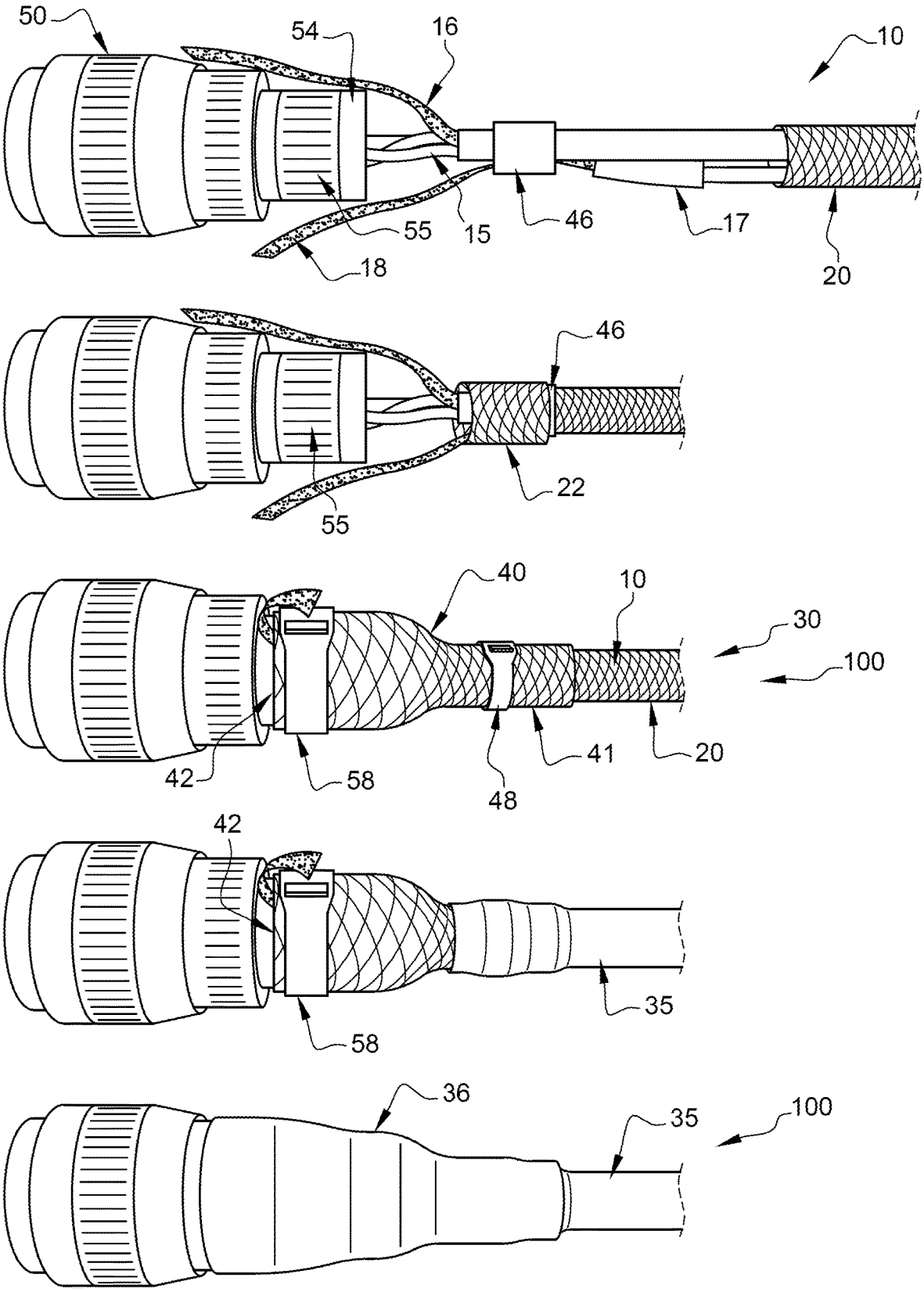
FIG. 2 shows various steps of producing the connection of FIG. 1.

FIG. 1 shows a connection 100 between an integrated coupling connector 50 and a reinforced harness 10 according to a preferred embodiment of the invention. FIG. 2 shows the same connection 100 at various assembly steps to facilitate the understanding of the invention.

The harness 10 is of a known type and includes cables 15 which are grouped together in a strand, the latter being surrounded by a reinforcement 20 (of the braided type) to protect it from electromagnetic (EM) interference. In this embodiment, the harness 10 also comprises individual reinforced cables. The cables 15 and the harness 10 comprise insulating layers. To couple this harness with an integrated coupling connector, it must be prepared.

In a known manner, the harness 10 is stripped and unreinforced towards one end, which consists in locally removing the outer insulation 12 and the reinforcement 20 of the harness 10. Then, the reinforced cables 15 of the harness are stripped at a location which is even closer to the end in order to then expose the conductive portion of the cables 15. The reinforced cables 15 can also be unreinforced, but while keeping their terminations of the reinforcements 16 attached to the harness 10.

The integrated coupling connector 50 is substantially cylindrical in shape with a sleeve 54 at the rear made of metal comprising a passage 53 giving access to its interior where the cables 15 of the reinforced harness 10 can be plugged into the integrated coupling connector 50. The outer side of the sleeve has an external coupling section 55. This section 55 is intended for the attachment of the reinforcement 20 of the reinforced harness 10 as well as for the take up of the reinforcement terminations 16 of the individual cables 15, if necessary. In contrast to a combined rear coupling and connector, the integrated coupling connector 50 is lighter in weight and less complicated to install.

As can be seen in FIG. 1, cables 15 of the harness 10 are received in the passage 53 of the integrated coupling connector 50. The conductive portions of the cables 15 are plugged into the integrated coupling connector 50 to electrically connect the cables 15 and the integrated coupling connector 50.

However, the harness 10 is small compared to this integrated coupling connector 50. More specifically, the diameter of its reinforcement 20 is too small to surround the section 55 of the integrated coupling connector 50 which has a greater diameter. The reinforcement 20 is made of metal, and cannot extend sufficiently, either materially or structurally, to fit to the diameter of the section 55. By way of example, the diameter of the section 55 may be comprised between 12 and 15 mm, while that of the reinforcement 20 may be comprised between 5 and 6 mm.

In order to allow the correct coupling of the harness 10 to the integrated coupling connector 50, while maintaining good EM protection, the reinforcement of the harness is widened. This reinforced harness with its widened reinforcement, called "widened reinforcement harness" allows to connect to the integrated coupling connector 50.

As can be seen from the figures, the widened reinforcement harness 30 comprises a non-deformable ferrule 46. The non-deformable ferrule 46 is in the shape of a short circular tube. It has a size which allows its installation around the reinforcement harness 10, being slightly larger than the diameter of the reinforcement 20 of the harness 10. It is installed at a position just behind the end of the reinforcement 20 of the harness 10. The reinforcement 20 however, which now passes inside the non-deformable ferrule 46, is folded on the outer side of the non-deformable ferrule 46 to form a folded portion 22, its end ending behind the non-deformable ferrule 46 as shown.

A reinforcement portion 40 is provided to fit the reinforcement 20 of the reinforced harness 10 to the section 55. It is distinct and does not form an integral part of the reinforcement 20 of the reinforced harness 10. The reinforcement portion 40 has a greater diameter than the reinforcement 20 of the harness 10. In particular, it is wide enough to surround the reinforcement 20 of the harness 10 folded on the non-deformable ferrule 46. At the same time, the other end of the reinforcement portion 41 is able to surround the section 55 of the integrated coupling connector 50, without being deformed.

The reinforcement portion 40 is typically straight. Alternatively, it can be produced in a flared manner, which can facilitate fitting to the smallest diameter of the harness 10, and the largest diameter of the integrated coupling connector 50. Moreover, its mesh and its material can be identical to those of the reinforcement 20 of the harness 10 in order to ensure good electrical continuity and good EM protection. Nevertheless, it is understood that even the latter can also be different according to the needs.

A first end 41 of the reinforcement portion 40 is positioned around the folded portion 22 on the ferrule. It is attached thereto with a clamp 48.

The non-deformable ferrule 46 is essential. It prevents the reinforcement 20 of the harness 10 from being crushed due to the tightening of the clamp 48. As the reinforcement 20 is not deformed, the mesh is respected, and the uniform protection guaranteed around the reinforced harness 10. Moreover, it allows the clamp 48 to tighten the reinforcement portion 40 against the folded portion 22 of the reinforcement 20 thus ensuring a reliable electrical connection therebetween. Preferably, it is made of metal, for example copper.

The second end 42 of the reinforcement portion 40 is positioned around the coupling section 55 of the integrated coupling connector 50. It is attached thereto with another clamp 58. In this case, the reinforcement terminations 16 of the reinforced cables 15 are also taken up on the same section 55, inside the second end 42 of the reinforcement portion 40. Of course, the two clamps 48, 58 on the connection 100 can be of the same size, or of different sizes. Preferably, they are made of metal.

In general, the reinforced harness 10 as well as the integrated coupling connector 50 are known parts. Moreover, the non-deformable ferrule 46, the reinforcement portion 40 and the clamps 48, 58 are also readily available standard parts.

In some cases, the reinforced harness 10 may also comprise a self-welding sleeve 17 connected to the reinforcement of a cable 15. The self-welding sleeve may also comprise a reinforcement termination 18 which may also be coupled to the section 55, such as terminations of the reinforcements 16 of the cables 15, inside the reinforcement portion 40. The self-welding sleeve 17 can advantageously be connected to the wiring behind the connection 100.

Furthermore, to ensure the tightness of the connection, a first heat-shrinkable sleeve 35 is provided around the harness 10, in particular enveloping the first end 41 of the reinforcement portion 40. A second sleeve 36 is provided enveloping the first end 41 of the reinforcement portion 40 as well as a portion of the first heat-shrinkable sleeve 35 above. This second heat-shrinkable sleeve 36 extends beyond the second end 41 of the reinforcement portion 40, and engages with a shoulder 56 on the integrated coupling connector 50. Therefore, it envelops all the conductive parts of the connection 100.

The heat-shrinkable sleeves 35, 36 protect the connection 100 from percolation of water, and from impacts. Moreover, they hide the portions of the connection 100 well and make them cleaner. The electrical connection 100 when complete is about the same size as that using a combined rear coupling and connector. Therefore, this has no impact on the routing of cables/harnesses in its vicinity.

A preferred method for coupling the reinforcement 20 of a harness 10 to a section 55 of an integrated coupling connector 50 will now be described. The reinforced harness 10 is first prepared, unreinforced and stripped as necessary. A non-deformable ferrule 46 is placed around the reinforced harness 10. Then, the reinforcement 20 of the harness 10 is folded on the outer side of the non-deformable ferrule 46.

A reinforcement portion 40, which is distinct and has a greater diameter than the harness reinforcement 20, is placed with a first end 41 around the folded portion 22 of the reinforcement 20 of the harness 10. The reinforcement portion 40 is then attached thereto with a clamp 48. The reinforcement 20 of the harness 10 is now widened, effectively forming a widened reinforcement harness 30. The second end 42 of the reinforcement portion 40 is placed around the section 55 of the integrated coupling connector, and is then attached thereto with another clamp 58.

Thanks to this invention, it is possible to couple a reinforced harness 10 with a small diameter to the integrated coupling connector 50. As the mesh of the reinforcement 20 of the harness 10 is not deformed, there are no windows through which the EM disturbances can be received or transmitted, and the precise protection granted to the reinforced harness 10 by the manufacturer is retained. Moreover, the reinforcement portion 40 extends from the reinforcement 20 of the harness 10 to the section 55 of the integrated coupling connector 50, and maintains good EM protection which is uniform and continuous around the connection 100. Ideally, the protection provided by the reinforcement portion 40 around the cables 15 is at least that provided by the reinforcement 20 of the reinforced harness 10. Furthermore, the connection 100 between the reinforced harness 10 and the integrated coupling connector 50 weighs less than a connection comprising a combined rear coupling and connector.

Although the invention has been explained in relation to an integrated coupling connector, it is understood however that the invention can be applied to other components, such as a standard rear coupling, and even those having a section which is not too wide for the harness. Of course, the invention can be used with various reinforced harnesses, whether of the braided type or otherwise. The invention can also be easily retrofitted to already existing connections in an aircraft. However, the invention is not limited to aircraft, and can be used in ships, buildings, etc.

What is claimed is:

1. A widened reinforcement harness comprising a reinforced harness, a non-deformable ferrule and a reinforcement portion which is distinct and has a greater diameter than the reinforcement of the harness, wherein the non-deformable ferrule is arranged around the harness with the reinforcement of the harness passing inside the non-deformable ferrule and folded on the outer side of the non-deformable ferrule, a first end of the reinforcement portion being attached around the folded portion of the reinforcement of the harness and a second end being arranged to be attached to a section of an electrical component.

2. The widened reinforcement harness according to claim 1, wherein the first end of the reinforcement portion is attached with a clamp.

3. The widened reinforcement harness according to claim 1, wherein a first heat-shrinkable sleeve envelops the first end of the reinforcement portion.

4. A connection, comprising the electrical component with a section and the widened reinforcement harness according to claim 1, wherein the second end of the reinforcement section is attached around the section of the electrical component.

5. The connection according to claim 4, wherein a second heat-shrinkable sleeve envelops the first end of the reinforcement portion as well as a portion of the first heat-shrinkable sleeve, and further envelops the second end of the reinforcement portion.

6. The connection according to claim 4, wherein the second end of the reinforcement portion is attached with a clamp.

7. The connection according to claim 6, wherein the electrical component is an integrated coupling connector.

8. A method for coupling the reinforcement of a reinforced harness to a section of an electrical component, the method comprising providing a non-deformable ferrule around the reinforced harness, folding the reinforcement of the harness from the inner side of the non-deformable ferrule to the outer side of the non-deformable ferrule, providing a reinforcement portion which is distinct and has a greater diameter than the reinforcement of the harness, attaching one end of the reinforcement portion around the folded portion of the reinforcement of the harness, and attaching the second end of the reinforcement portion to the section of the electrical component.

9. The method according to claim 8, said method comprising attaching each of the ends of the reinforcement portion with a clamp.

10. The method according to claim 8, said method comprising attaching the reinforcement of the harness to the section of an integrated coupling connector.

* * * * *